US007036715B2

(12) United States Patent
Lo Duca

(10) Patent No.: US 7,036,715 B2
(45) Date of Patent: May 2, 2006

(54) BOX WITH POCKET FOR ILLUSTRATIVE LEAFLET

(75) Inventor: Carmelo Lo Duca, Milan (IT)

(73) Assignee: GI.Biieffe S.r.l., Milan (IT)

( * ) Notice: Subject to any disclaimer, the term of this patent is extended or adjusted under 35 U.S.C. 154(b) by 178 days.

(21) Appl. No.: 10/601,845

(22) Filed: Jun. 24, 2003

(65) Prior Publication Data

US 2004/0011858 A1 Jan. 22, 2004

(30) Foreign Application Priority Data

Jul. 3, 2002 (IT) ..... MI2002A1474

(51) Int. Cl.
*B65D 5/486* (2006.01)

(52) U.S. Cl. ..... 229/120.18; 206/232; 229/123

(58) Field of Classification Search ..... 229/123, 229/153, 120.08, 120.15, 120.18; 206/232, 206/831

See application file for complete search history.

(56) References Cited

U.S. PATENT DOCUMENTS

| | | | | | |
|---|---|---|---|---|---|
| 1,374,956 | A | * | 4/1921 | Schneider | 229/123 |
| 3,147,856 | A | * | 9/1964 | Lightner et al. | 206/831 |
| 3,533,546 | A | | 10/1970 | Kossnar | |
| 4,125,185 | A | * | 11/1978 | Bliss | 229/120.18 |
| 5,007,537 | A | * | 4/1991 | Ackeret | 206/232 |
| 5,078,268 | A | * | 1/1992 | Olson et al. | 206/232 |
| 5,103,972 | A | * | 4/1992 | Ackeret | 206/232 |
| 5,353,931 | A | * | 10/1994 | Antik | 206/232 |
| 5,513,752 | A | * | 5/1996 | Gottlieb | 229/120.18 |
| 5,860,589 | A | * | 1/1999 | Hsu | 206/232 |
| 5,944,183 | A | * | 8/1999 | Rowland et al. | 229/120.18 |
| 5,971,261 | A | * | 10/1999 | Grunfeld et al. | 229/153 |
| 6,070,719 | A | * | 6/2000 | Pollock | 206/232 |
| 6,702,108 | B1 | * | 3/2004 | Lo Duca | 229/120.18 |

FOREIGN PATENT DOCUMENTS

| | | | |
|---|---|---|---|
| DE | 3208777 | * | 9/1983 |
| DE | 8618368 | | 10/1986 |
| DE | 29901874 | | 6/1999 |
| EP | 911266 | * | 4/1999 |
| EP | 1219542 | * | 7/2002 |
| GB | 2277077 | * | 10/1994 |
| JP | 2000-296839 A | * | 10/2000 |

* cited by examiner

*Primary Examiner*—Gary E. Elkins
(74) *Attorney, Agent, or Firm*—Oblon, Spivak, McClelland, Maier & Neustadt, P.C.

(57) ABSTRACT

A box formed from a single piece of cardboard and having internal flaps presenting a folding line in correspondence with one of the edges of the box, to define with those two lateral panels of the box adjacent to it a corner pocket housing an illustrative leaflet or the like which is folded on itself and is housed in correspondence with the edge of the box.

2 Claims, 4 Drawing Sheets

BOX WITH POCKET FOR ILLUSTRATIVE LEAFLET

FIELD OF THE INVENTION

The present invention relates to a box formed from a single piece of cardboard and defining in its interior a pocket into which, during the manufacture of the box, a leaflet can be inserted illustrating that product which is later to be inserted therein by the firm which uses the box.

BACKGROUND OF THE INVENTION

The term "illustrative leaflet" means any sheet, possibly folded several times on itself, carrying writing and instructions relative to the product contained in the box, or a card extractable from the pocket and having images or writing of any type reproduced on it.

DESCRIPTION OF RELATED ART

Many products or articles are housed, preserved and transported in boxes or cases, normally of cardboard construction; very often, illustrative leaflets or the like are also inserted into these boxes. A frequent example is that in which the articles or products inserted into the boxes are containers of various kinds, bottles, or flat packs defining a plurality of recesses containing pharmaceutical products: in this latter case, the leaflets illustrating the pharmaceutical products must compulsorily be present in the actual boxes into which the bottles, containers or the like are inserted.

In the usual known art, the boxes are produced by specialist firms, whereas the pharmaceutical industry (or other box user) directly provides for inserting the bottles or the like together with the relative illustrative leaflets into them: this operation is relatively laborious and slow, especially as a result of the difficulties encountered in inserting the leaflet (often of large dimensions and folded over several times) into the box in such a manner that it still allows the bottle or pack to be freely inserted without the leaflet becoming creased.

To obviate these problems boxes have been proposed formed from a single piece of cardboard and defining in their interior a pocket into which the illustrative leaflet is inserted directly by the firms producing the boxes, the users of which have then merely to insert the articles (bottles or other articles) which the box is to contain.

Obviously, the leaflet must be retained inside each box in a secure manner so that it does not interfere with the article inserted into the box by the box user or box preparer. Moreover the boxes must have a structure such that the illustrative leaflets can be inserted into them very simply and rapidly by the box manufacturer, directly while the boxes are being formed.

DESCRIPTION OF THE RELATED ART

GB-A-2277077 (see FIGS. 3 and 4) and DE-A-3208777 (see FIG. 2) describe boxes, into the interior of which there projects a flap which on one of its sides is rigid with one of the main side walls of the box, this flap facing a different main wall of the same box to form therewith a pocket housing the illustrative leaflet: these boxes cannot be used industrially because the flap which defines the pocket is connected to the box structure along only one of its sides, hence the flap can freely flex (or "open") towards the box interior, so preventing mechanical insertion thereinto of bottles or other packs of products to which the leaflet refers.

U.S. Pat No. 3,147,856 (FIG. 3), EP-A-0911266 (FIG. 2) and DE 8618368U (FIG. 2) describe boxes similar to those of the two aforementioned patents, but in which the flap defining (with the box outer wall to which it is parallel and from which it is spaced) the pocket in the box interior has its free end folded at 90° about itself to form a tab (indicated by the reference numeral 42 in U.S. Pat. No. 3,147,856, by the numeral 16 in EP-A-0911266 and by the numeral 11 in DE 8618368U) which is glued to the adjacent main side wall of the box. These boxes present serious drawbacks, consisting of the fact that as the aforesaid flap has to be glued to the main wall during production of the boxes, which are despatched to the user firms as packs of identical boxes flattened against themselves, it becomes impossible to produce the boxes. To better understand this problem, it will be assumed that the boxes of FIG. 3 of U.S. Pat. No. 3,147,856 and FIG. 2 of EP-A-0911266 have to be flattened against themselves (as shown in FIG. 2 of U.S. Pat No. 3,147,856) to be able to be stacked and despatched to the user. If the flaps 42 and 16 of the two boxes respectively are glued to the adjacent main surfaces of the boxes, it becomes impossible to flatten the boxes without damaging them; likewise the boxes cannot be brought from their flattened state to their shaped state, ready for inserting into them the products which they have to contain.

In contrast, if the flaps 42 and respectively 16 are not glued, the same drawbacks mentioned for the aforesaid already discussed patents arise.

DE 29901874U describes a box the end flap of which is folded towards the box interior and is glued onto another flap of the same box, also projecting towards the box interior, to hence define a pocket which enables an illustrative leaflet to be housed, but which prevents the user mechanically inserting into the shaped box the articles which it is intended to contain, because this is prevented by those flaps of the box which are glued together and project towards the box interior.

Patent application EP-A-1219542 describes a box formed from several flaps or walls, two flaps or walls being folded into the box interior and being parallel to and adhering to corresponding outer walls of the box and being free, i.e. not fixed to the adjacent side walls of the box, to define a corner pocket housing an illustrative leaflet or the like folded at a right angle to itself and positioned in correspondence with a longitudinal edge of the box, between two consecutive outer walls of the box and between the two flaps which are adjacent to them inside the box (see FIGS. 7 and 8 of EP-A-1219542). This embodiment presents the drawback that the free inner end flap of the box can easily flex towards the box interior, so interfering with the articles to be inserted into the finished box which contains the illustrative leaflet.

BRIEF SUMMARY OF THE INVENTION

The main object of the present invention is to provide a box formed from a single piece of cardboard and defining a pocket for housing an extractable leaflet, in which the box is of very simple structure and manufacture and especially in which said pocket is defined by two outer main panels of the box and by supplementary flaps or panels which extend into the box and are prevented from turning within the box under any condition in which the box is used.

These and other objects are attained by a box having the characteristics specified in the following claim 1.

BRIEF DESCRIPTION OF THE SEVERAL VIEWS OF THE DRAWINGS

The structure and characteristics of the box will be more apparent from the ensuing description of one embodiment thereof given by way of non-limiting example with reference to the accompanying drawings, in which.

Figure 1:
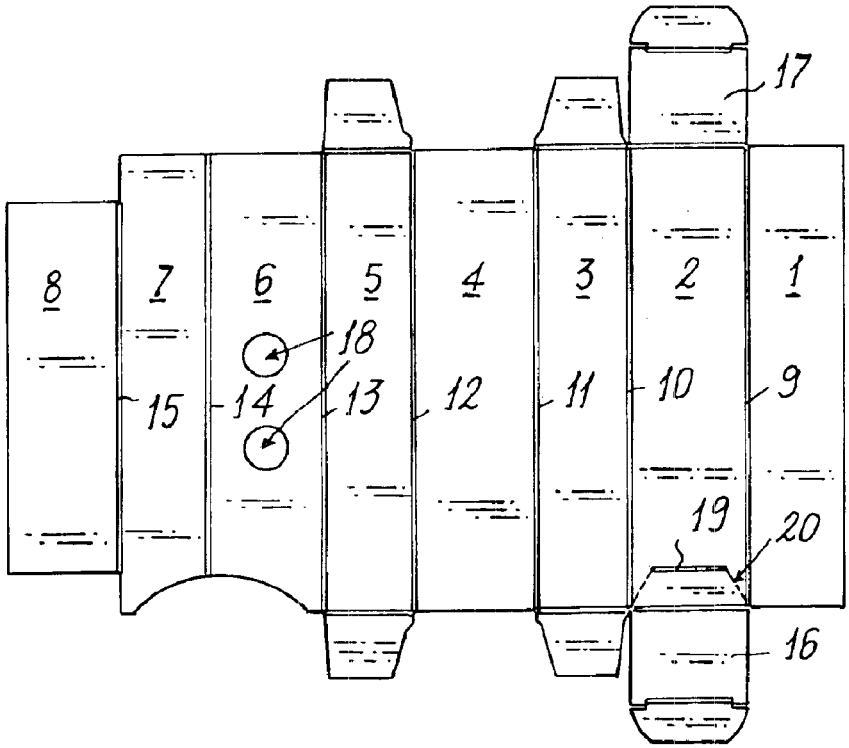
FIG. 1 is a plan view of a spread-out punched and crease-lined piece of cardboard usable for forming a box, the figure showing that surface of the cardboard sheet which is to remain on the inside of the box.
Figure 9:
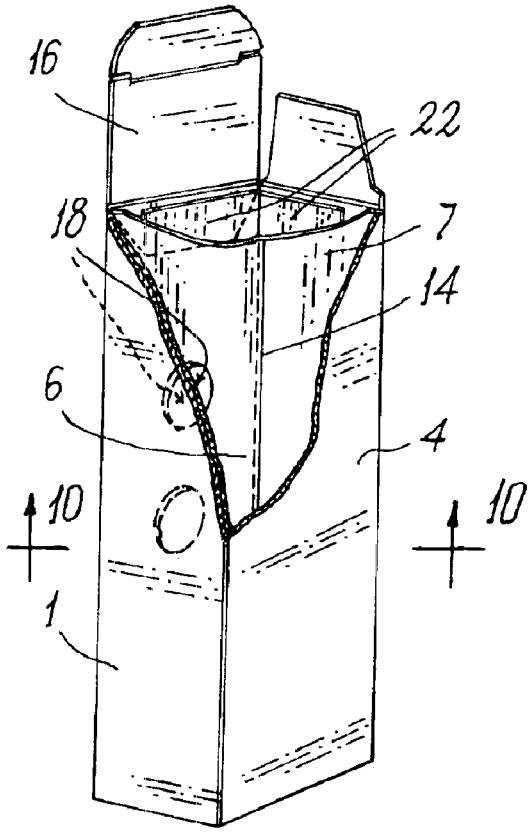
Figure 10:
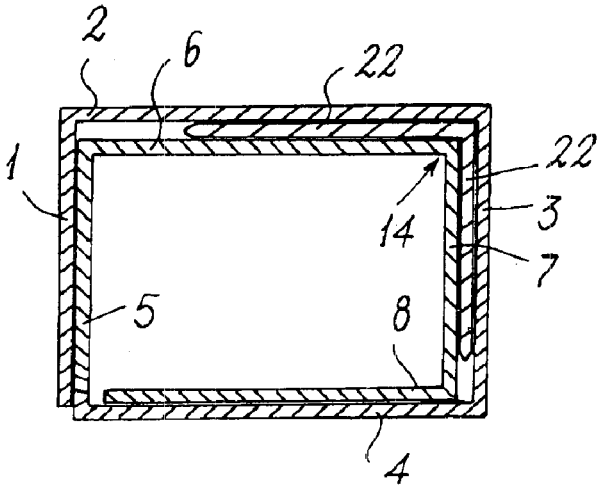

FIGS. from 2 to 8 show the piece of cardboard of FIG. 1 in its successive folding steps to form the box;

FIG. 9 is a perspective view of the finished box with its upper lid open, a portion of the box having been omitted to allow clearer vision of its interior; and FIG. 10 is a cross-section through the box on the line 10—10 of FIG. 9, on an enlarged scale.

DETAILED DESCRIPTION OF THE INVENTION

Reference will firstly be made to FIG. 1, which shows a spread-out piece of punched, crease-lined and knurled cardboard seen from its inner side, i.e. the opposite side to that on which the descriptive matter which has to be visible on the outside of the finished box is printed.

The cardboard sheet comprises four consecutive main panels 1–4 and four supplementary flaps or panels 5–8 projecting from the main panel 4; the said panels and flaps are separated one from another by crease lines, i.e. longitudinal parallel folding lines 9–15. From the two opposite ends of the main panel 2 there project two closure panels 16 and 17 (separated from the main panels by transverse crease lines or folding lines perpendicular to the folding lines 9–15), intended to form the lid and respectively the base of the box. From opposing sides of the panels 3 and 5 there also project foldable flaps which for simplicity are not numbered.

The structure of the cardboard piece described up to this point is totally traditional.

From the main panel 4, there project the stated supplementary panels 5, 6, 7.

Figure 3:
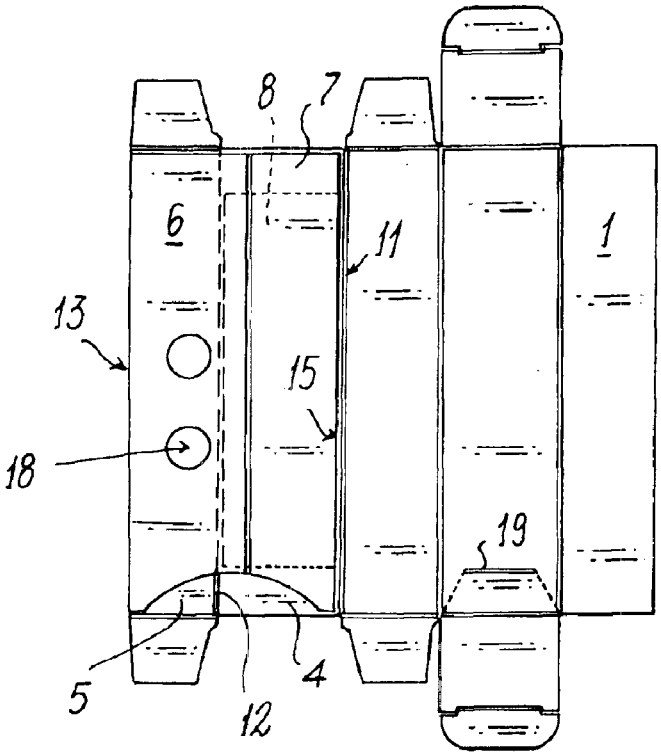

From the drawings (in particular from FIG. 3) it can also be seen that the total width of the supplementary panels 6 and 7 is less than the total width of the two panels 4 and 5, so that when the supplementary panels 6 and 7 are folded onto the two panels 4 and 5, the two folding lines 12 and 14 are not superposed one on the other and the crease line 15 is parallel to but slightly spaced from the folding line 11 (as can be seen from FIG. 3 in particular).

Advantageously, short longitudinal cuts (for simplicity not shown) can be formed in correspondence with the folding lines 13 and 14 to facilitate the folding of the supplementary panels about these lines 13, 14.

The upper edge (shown facing downwards in FIGS. from 1 to 8) of the supplementary panels 6 and 7 is preferably profiled, i.e. defined by an arc-shaped line (see the figures) to facilitate insertion of a bottle (or other article) into the finished and prepared box.

Finally, from the drawings it can be seen that in the supplementary panel 6 there are provided two windows 18 through which (when the box lid is open) it can be seen whether an illustrative leaflet is present in the internal pocket of the box, and any code with which the leaflet is provided can be read.

The box described up to this point, excluding the presence of the flap 8, has already been described in detail in EP-A-1219542.

It can also be seen that the main panel 2 is provided with a short crease line 19 from the ends of which there extent two knurled lines 20 the purpose of which is to enable the panel 2 to be partly torn and the box lid 16 to be folded outwards when the illustrative leaflet is to be extracted therefrom.

It will now be assumed that the cardboard processing firm which has produced the punched and crease-lined cardboard sheet of FIG. 1 then folds it in order to form from it the box to be despatched to the box user.

Figure 2:
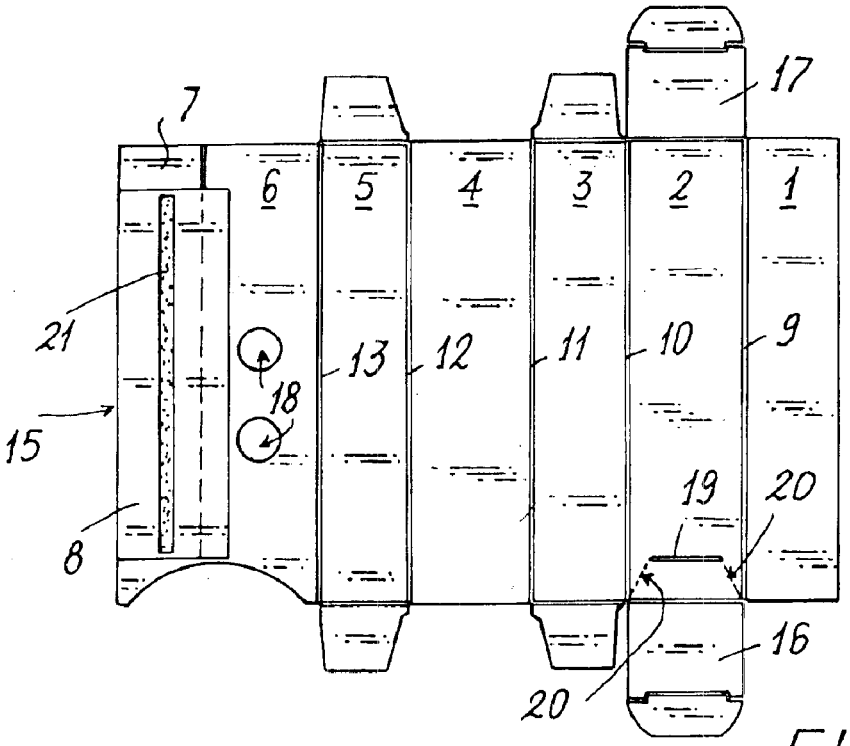
Figure 4:
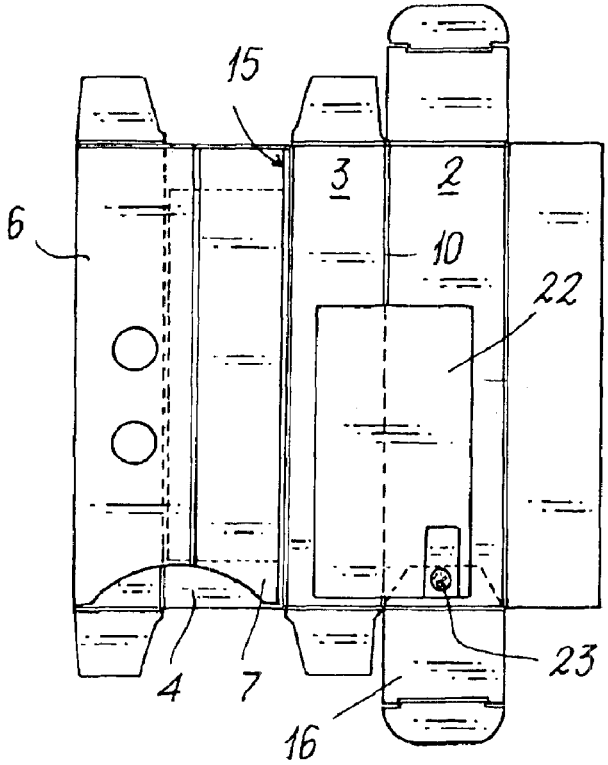
Figure 5:
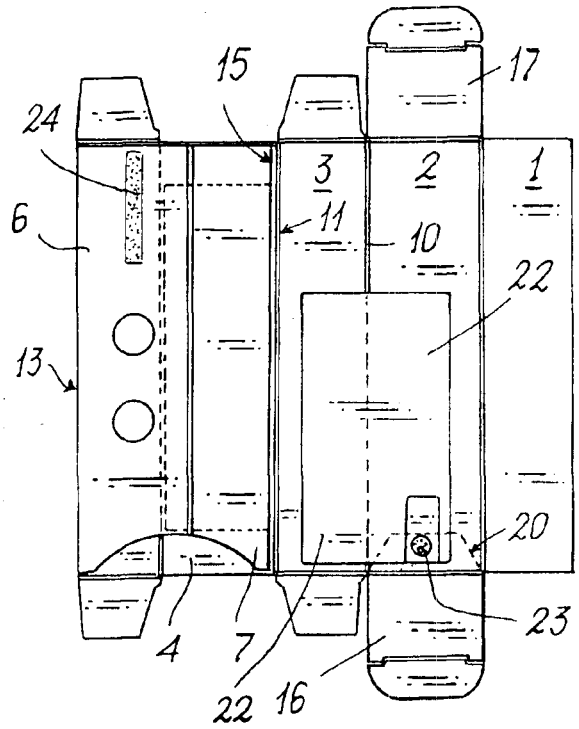

In a first step, the flap 8 is folded onto the supplementary panels 6 and 7 and a strip of glue 21 is applied to the outer surface of the flap 8 (FIG. 2), then the panels 6 and 7 (together with the flap 8) are folded about the crease line 13 to superpose them on the panels 4 and 5 (FIG. 3). An illustrative leaflet 22 is then rested on the main panels 2 and 3, in proximity to the lid 16, the leaflet 22 being secured to the panel 2 with a spot of low-adhesive glue, such as to enable the leaflet to be easily detached from the panel 2 (FIG. 4). A short strip of glue 24 is then applied to the outer surface of the panel 6 in proximity to that end at which the bottom panel 17 is provided (FIG. 5).

Figure 6:
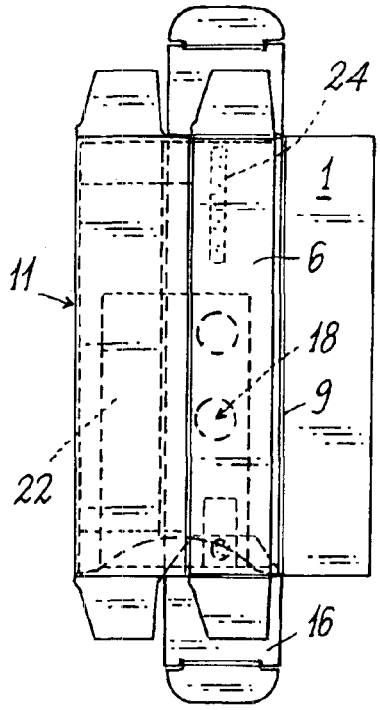

The cardboard sheet is then further folded about the folding line 11 (FIG. 6), so that the supplementary panels 6 and 7 rest on the inner surface of the panels 2 and 3, to form therewith a pocket in which the illustrative leaflet 22 is housed.

Figure 7:
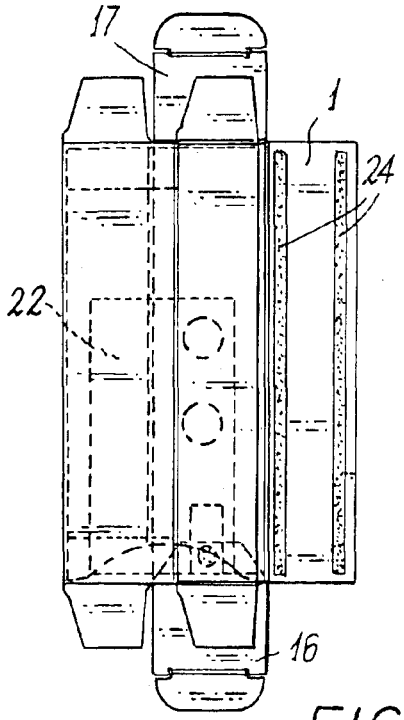
Figure 8:
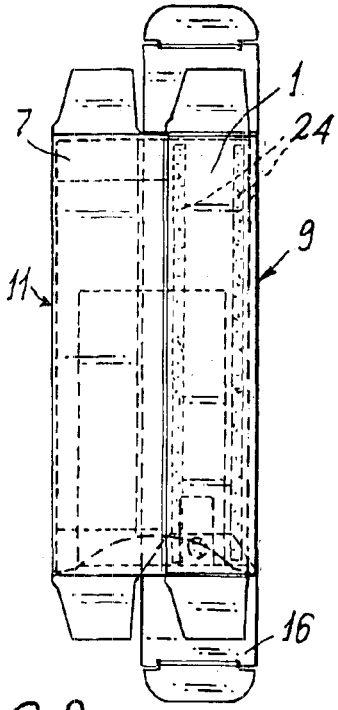

Two strips of glue 24 are applied to the inner surface of the panel 1 (FIG. 7) and the panel 1 is folded about its crease line 9 to superpose it and securely fix it (by the two strips of glue 24) onto the outer surface of the panel 5 (FIG. 8).

All the aforedescribed operations can be effected easily at high speed by those cardboard processing firms which produce traditional boxes, employing those automatic machines commonly used by said firms.

The user firm which receives the box already glued and folded as shown in FIG. 8 then uses its automatic machines of normal use to shape the box by closing the bottom panel 17, but leaving the upper panel or lid 16 open (see FIG. 9 which is rotated through 180° with respect to FIGS. 1–8), then inserts into the box the article which it is to contain. For example if the user firm produces pharmaceutical specialities, the article which it inserts into the boxes can be a bottle (not shown in the drawings).

As only a bottle or other article has to be inserted into the box, this can be done at high speed with known machines, obviously with great advantage to the user firm because it does not have to take care to introduce also the illustrative leaflet into the box and it does not have to take particular care to prevent the bottle or other product (when being inserted into the box) from interfering with the leaflet to deform it and crush it.

On using the box of the invention, when this is pressed to change it from the position of FIG. 8 to that of FIG. 9, the supplementary panels 6 and 7 automatically fold outwards about the folding line 14 which separates them (as the panel 8 is glued to the panel 4, and the panel 6 is glued to the panel 2 only by a short strip 24 of glue situated in proximity to that end of the panel 6 distant from the other end at which the panels 6 and 7 present an arc-shaped recess) and which enables the illustrative leaflet to be gripped and extracted from the box, this operation being facilitated by the outward rotation of the lid 16, after tearing the knurlings 20.

The curved or inclined free edge with the arc-shaped recess of the supplementary panels 6 and 7 also serves the purpose of facilitating the insertion of the said bottle into the box, preventing it from becoming blocked against the free edge of these panels.

It will be immediately noted that the presence of the panel 8 and the fact that it is glued to the inside of the panel 4 provide great stability to the corner pocket into which the illustrative leaflet is inserted, preventing any part of the panels or flaps defining the corner pocket and also the leaflet itself from projecting into the box, with the result that any article can be inserted with great speed and safety into the box already containing the leaflet.

I claim:

1. A box with a pocket for an illustrative leaflet and formed from a single piece of punched and crease-lined cardboard, comprising:

at least four main panels and four supplementary panels, all consecutive, separated one from another by parallel longitudinal folding lines, a first of said main panels being superposed on and glued to a first of the supplementary panels in the box, at least two panels for closing two ends of the box and projecting from ends of at least one of the main panels from which the at least two panels for closing are separated by transverse folding lines substantially perpendicular to said longitudinal folding lines, wherein a last of of the supplementary panels is separated from an adjacent one of the supplementary panel by an additional folding line parallel to said longitudinal folding lines, a width of said last supplementary panel being less than a width of the last main panel from which the supplementary panels extend, a width of two supplementary panels adjacent to the last supplementary panel being overall less than a total width of the last main panel and of the first supplementary panel consecutive to the last main panel, the supplementary panels being folded into the box, the last supplementary panel being glued to an inside of the last main panel, and the first main panel being glued to the first supplementary panel on which the first main panel is superposed inside the box, the supplementary panels forming with the adjacent main panels a corner pocket in which said illustrative leaflet is configured to be housed.

2. The box as claimed in claim 1, wherein the second supplementary panel is glued at one end to the main panel of the box overlying and adjacent the second supylementary panel.

* * * * *